US006265048B1

(12) United States Patent
Rydin et al.

(10) Patent No.: US 6,265,048 B1
(45) Date of Patent: Jul. 24, 2001

(54) LAMINATED CLOTHING, AS WELL AS METHOD AND BLANK FOR MANUFACTURING THE SAME

(75) Inventors: Björn Rydin, Holm (SE); Douglas L Horanburg, East Greenbush, NY (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 08/897,179

(22) Filed: Jul. 21, 1997

Related U.S. Application Data

(63) Continuation of application No. PCT/SE96/01536, filed on Nov. 26, 1996.

(30) Foreign Application Priority Data

Nov. 30, 1995 (SE) ..... 9504275

(51) Int. Cl.[7] ..... B32B 3/04

(52) U.S. Cl. ..... 428/121; 428/130; 428/192; 428/193; 28/142; 139/383 A; 139/383 AA; 245/10

(58) Field of Search ..... 428/222, 223, 428/121, 130, 192, 193; 28/142; 139/383 A, 383 AA; 245/10

(56) References Cited

U.S. PATENT DOCUMENTS 4,315,049 2/1982 Fickers .
4,695,498 * 9/1987 Sarrazin et al. ..... 428/223
4,896,702 1/1990 Crook .
5,015,220 * 5/1991 Legge et al. .
5,360,656 * 11/1994 Rexfelt et al. ..... 428/193

FOREIGN PATENT DOCUMENTS 1056351 1/1967 (GB) .
2060016 4/1981 (GB) .

* cited by examiner

*Primary Examiner*—Elizabeth M. Cole
(74) *Attorney, Agent, or Firm*—Pitney, Hardin, Kipp & Szuch LLP

(57) ABSTRACT

The invention relates to a laminated clothing for a paper-making or cellulose manufacturing machine, as well as a method and a blank for manufacturing thereof. The clothing comprises two laminated layers (O, I), each having an inclined direction-defined thread system, the thread systems being inclined relative to the machine direction of the clothing and relative to each other. The two layers (O, I) constitute an upper and an inner part, respectively, of an endless band (40), which is so flattened that two edge folds (48, 50) are formed transversely of the machine direction, and which is then doubled with the edge folds (48, 50) coupled together. As a result, the band comprises a direction-defined thread system which is inclined relative to the machine direction and which, owing to the flattening and doubling of the band, forms the thread systems, inclined relative to each other, of the first and the second layer (O, I).

14 Claims, 8 Drawing Sheets

LAMINATED CLOTHING, AS WELL AS METHOD AND BLANK FOR MANUFACTURING THE SAME

This is a continuation of PCT/SE96/01536, filed Nov. 26, 1996.

The present invention generally relates to a laminated clothing, such as a laminated press felt, for use in a papermaking or cellulose manufacturing machine. More specifically, the invention relates to a clothing having in its thickness direction a first and, laminated therewith, a second layer, each having a direction-defined thread system, said thread systems making an angle with the machine direction of the clothing and with one another. The invention also relates to a method and a blank for manufacturing such a laminated clothing. SE 468,602 discloses a laminated press felt of the above-mentioned type, and a method of manufacturing the same.

The press felt in a papermaking machine has, like other clothings (forming fabrics, drier fabrics etc.), changed a great deal in the last decades. A modern press felt comprises a soft compressible part adjacent to the paper web for protection, and a relatively incompressible part, called base fabric, for receiving and removing water pressed out in the press nips. The compressible part usually is a single- or double-face fiber layer needled to the base fabric. The base fabric usually consists of woven monofilaments, but also spun threads or twisted multifilaments are used. As material in the fibre layer and the base fabric, use is often made of polyamide, which is an impact-resistant fibre that does not fibrillate owing to repeated compressions in a press nip.

At the beginning of the 70's, it was considered in this technical field that future press felts would contain a small amount of base fabric or even be completely without base fabric. However, the development has been completely reversed. More rapid machines having greater and greater pressing pressures have required press felts of higher and higher stability, improved strength properties and conditionability, and therefore the amount of press felts having a thicker base fabric and multilayer design has increased constantly.

In so-called laminated press felts, which are a special type of multilayer press felts and which have implied a great step forward, two base fabrics are included, which have separate thread systems and which are combined, i.e. laminated, while manufacturing the felt. Laminated press felts are particularly used in highly loaded press positions where large amounts of water are to be processed, in many cases requiring low marking. By different combinations of top and bottom fabrics it has been possible to adapt the structure to demanding machine positions.

At the beginning of the 90's, a new type of laminated press felt was introduced, marketed under the designation DYNATEX™ supplied by Albany International Corp., at least one of the two base fabrics, i.e. one of the two layers laminated with each other, consisting of a spirally rolled strip, preferably a flat-woven strip. This spirally rolled base fabric is the subject matter of SE 468,602 mentioned by way of introduction. The principle is illustrated in FIG. 1 on the accompanying sheet of drawing, which illustrates schematically and from above a method of manufacturing such a spirally rolled base fabric. Two rotatably mounted rollers 10, 12 having parallel axes are arranged at a mutual axial distance D. A supply coil 14 is rotatably arranged about an axis 16 and movable in parallel with the shafts 10 and 12, as indicated by arrow 18. The supply coil 14 accommodates a rolled-up supply of a flat-woven strip 20 of fabric made from yarn, having a width w between its longitudinal edges 26 and 28. The strip 20 is composed of two mutually perpendicular thread systems consisting of longitudinal threads (warp threads) and transverse threads (weft threads), respectively, schematically shown at 22 and 24, respectively. As the supply coil 14 is moved from the left to the right in the Figure, the strip 20 is discharged in the direction of arrow 30 to be spirally rolled about the shafts 10, 12 into an endless product, below called "endless band", generally designated 40. The final width of the band 40 is designated B and is defined by lines 34 and 36 along which the sides of the band 40 are cut after the spiral rolling.

As illustrated in FIG. 2, the strip 20 is applied at an angle $\alpha$ to the machine direction which is designated MD and which is the running direction of the finished press felt in the machine. The longitudinal edges 26, 28 of the strip 20 can be made to be positioned edge by edge or in overlapping fashion, preferably joined together. The completed, laminated press felt has a width B which is determined by the number of spiral turns, and a length equalling approximately twice the axial distance D and thus easily being possible to vary by changing D. The advantages of this prior-art spiral rolling is disclosed in SE 468,602 and will not be repeated here.

A special advantage has been obtained with a multiaxial variant of DYNATEX™, where two spirally rolled endless base fabric bands as described above are laminated in such a manner that the spiral turns of one band intersects the spiral turns of the other band. It is possible to manufacture such a multiaxial, laminated base fabric by spirally rolling a first base fabric band according to FIG. 1, and spirally rolling a second base fabric band of essentially the same length, but of opposite pitch angle (i.e. the strip in the second base fabric band is directed obliquely upwards to the right instead of obliquely upwards to the left as in FIG. 1). Subsequently, these two endless bands are inserted into one another to form a laminated base fabric, which, seen from above, has on the one hand two systems of longitudinal threads 22 making an angle with each other and with the machine direction MD and, on the other hand, two systems of transverse threads 24 making an angle with each other as well as with the longitudinal threads 22 and the machine direction MD, i.e. totally four thread directions. The multiaxial, laminated base fabric can then be provided with a needled batt layer, which produces a joining effect on the two layers. The resultant product is called a multiaxial, laminated press felt.

Runs with multiaxial laminated press felts have conferred a number of advantages, mainly an improved stability as to shape under pressure thanks to the crossing of the thread systems preventing them from sliding into each other, i.e. improved incompressibility. A further advantage is that the life of the press felt increases since it will keep more open for a longer time and, thus, its properties change less in time.

A problem of the multiaxial laminated press felt, however, is that the manufacture thereof in respect of lamination is relatively complicated and time-consuming.

A further problem of the multiaxial laminated press felt is that it has no openable seam, and therefore cannot be installed and run in machine positions requiring a seamed felt.

A special difficulty regarding the problem of the missing openable seam is that modern techniques for manufacturing openable seams can be used for "perpendicular" thread systems only, i.e. thread systems running in MD (machine direction) and CD (cross machine direction).

To solve the first problem—a complicated and time-consuming manufacture—the invention suggests a laminated clothing and a method for manufacturing a laminated clothing having the features defined in claims 1 and 7, respectively. According to one aspect of the invention, also a blank intended for the manufacture of a laminated clothing is provided according to the claim 14.

The term "clothing" means either a finished product for installation, for instance a press felt comprising a laminated base fabric and, needled thereto, a batt, or part of a finished product, for instance merely a laminated base fabric for a press felt. The term "clothing" should further not be considered limited to the field of press felts. Other possible fields of application for the invention are LNP bands (long nip presses), transfer bands, clothings for forming or drying, etc.

Thus, according to the invention a laminated clothing for a papermaking or cellulose manufacturing machine is provided, said clothing having in its thickness direction a first and, laminated therewith, a second layer, each having an inclined direction-defined thread system, said thread systems being inclined relative to the machine direction of the clothing and relative to one another. The new and characteristic features of the clothing according to the invention are that the first and the second layer constitute an outer and an inner part, respectively, of an endless band which is so flattened that two edge folds are formed transversely of the machine direction, and which is then doubled with the edge folds coupled to each other, said band having a direction-defined thread system which is inclined relative to the machine direction and which, owing to said flattening and doubling of the band, forms the thread systems, inclined relative to each other, of the first and the second layer.

A technical effect that is essential to and characteristic of the invention is that the crossing of the thread systems which are included in the laminated layers and which in the finished product make an angle with each other as well as with the machine direction, is effected fully automatically by the flattening and doubling of one and the same endless band. If the inclined, direction-defined thread systems of the endless band make an angle of, for instance, $+\alpha$ with the machine direction MD, the flattened and doubled band will have, as seen perpendicular to its major face, two thread systems which make an angle $2\alpha$ with each other and which make an angle $+\alpha$ and $-\alpha$, respectively, with the machine direction MD.

A multiaxial laminated clothing of the above design is easier to manufacture since the entire clothing keeps together, compared with the known technique of manufacturing the laminated clothing from two initially separate bands. No adaptation in respect of dimensions of two separate bands is required. Moreover, the time of manufacture is reduced since merely one endless band has to be manufactured. A further advantage is that the product properties, such as tendency to shrinkage and angles of the thread system, will be uniform in the laminated layers.

In its widest aspect, the endless band can be manufactured in any fashion whatever, provided that it comprises at least one inclined, direction-defined thread system which makes an angle with the longitudinal direction of the band. For instance, the endless band may also be a warp knit. Further the term "endless band" also comprises bands having one or more openable seams in their transverse direction, even if such a design probably is less preferable.

According to a preferred embodiment of the invention, the endless band is formed of a spirally rolled strip, which has a width smaller than the width of the band and which has a direction-defined thread system extended in the longitudinal direction of the strip and forming the inclined, direction-defined thread system of the endless band.

According to this embodiment using a spirally rolled strip, a new advantage is achieved owing to the doubling, in addition to the known advantages of spiral rolling. To obtain the same positive and negative pitch angles ($\alpha$ and $-\alpha$) as in the prior-art multiaxial product, it is in fact necessary to use twice the width of the strip. This implies in turn a smaller amount of meters of strip to be joined. Now supposing, for instance, that, for the manufacture of the prior-art spirally rolled base fabric in FIG. 1, the axial distance D is 10 m and the pitch angle of the strip relative to MD is $\alpha$, which results in an endless band having a total length of about 20 m. If the inventive clothing is to be manufactured from an endless band formed of a thus spirally rolled strip, the axial distance D must be doubled, i.e. 20 m, for forming an about 40-m-long endless band. This increased axial distance implies that the width of the strip must be substantially doubled if the pitch angle is to remain equal to $\alpha$. Starting from and spirally rolling a wider strip contributes in an advantageous manner to a shorter time of manufacture, on the one hand in respect of the time required for manufacturing the actual strip and, on the other hand, regarding the time required for spirally rolling and joining the spiral turns. A further advantage of the design having a spirally rolled strip is that it is possible to better check the angle of the threads in the two laminated layers.

The inventive principle of providing the multiaxial. configuration from one and the same endless band by flattening and doubling the same also makes it possible to provide the clothing with an openable seam adjacent to the coupled-together edge folds. Even if designs of the invention having an openable seam are preferred, the field of definition of the claims should, however, also be considered to comprise clothings without an openable seam for the probably less interesting case of permanently coupled-together edge folds.

According to a preferred embodiment, the edge folds of the band are openably joined by means of two rows of seam loops, said rows forming together with a pintle wire an openable seam of the clothing. It should be noted that the main principle of the invention—flattening and doubling an endless band having an inclined thread system—is a directly contributory cause of the fact that it is at all possible to provide an openable seam in a clothing having inclined thread systems.

Openable seams with seam loops and pintle wires are per se previously known, but arranging rows of seam loops in a structure having inclined thread systems, i.e. thread systems making an angle with MD as well as CD, is something completely new, especially in a laminated structure. Modern techniques for manufacturing seam loops in a fabric are all dependent on the fact that the fabric has an MD thread system which can either on its own form the seam loops or hold seam spirals inserted in the CD direction.

An example of a prior-art loop seam of a press felt having MD thread systems is disclosed in SE 429,982, which relates to a non-laminated press felt comprising a base fabric having two layers of MD threads, which form seam loops in the transition between the layers.

Furthermore, FI 77072, EP-B1-0 425 523 and U.S. Pat. No. 5,015,220 disclose clothings, in which an endless band having perpendicular thread systems has been flattened and doubled, the two edge folds being openably joined by means of seam loops formed of MD threads. In all these prior-art techniques, the existence of MD threads is an absolute condition for the possibility of forming seam loops. The seam loops are formed of the MD threads as these turn in the edge folds. One generally opens the material along the edge folds by ravelling a number of CD threads, thereby forming open loops adjacent to the edge folds. None of these prior-art techniques for manufacturing seam loops in a doubled construction therefore is usable for the invention, which has inclined (not perpendicular) thread systems. Although it is thus per se know to flatten and double an endless band to a laminated clothing and couple together the edge folds, use is made, in all such known constructions, of materials having perpendicular thread systems since this is a condition for the manufacture of openable seams. Consequently, these prior-art solutions especially do not have the technical effect that is characteristic of the invention—automatic crossing of the thread systems of the layers owing to flattening and doubling.

A drawback of the prior-art techniques for manufacturing seam loops is that they cause an undesired change of the structure and properties of the material along the rows of seam loops owing to the ravelling of CD threads.

According to one embodiment of the invention, a new technique is suggested, which permits manufacture of seam loops in a clothing having inclined thread systems, especially in a laminated clothing having inclined, intersecting thread systems. According to this embodiment of the invention, the seam loops are manufactured from a separate filament, below called seam loop thread, which is formed, by means of a special loop-forming device, into loops in the band. The structure of the endless band is neither damaged nor influenced, and the technique does not require the existence of MD threads in the band material. For manufacturing a row of seam loops, the loop-forming device and the band are caused to move relative to each other along the intended seam line, i.e. perpendicular to the longitudinal edges of the band, before carrying out the final doubling. During this relative movement of the loop-forming device and the band, the seam loop thread is pulled in double state through the band in the thickness direction thereof in each point that is to be provided with a seam loop. This operation is carried out with a thread guide entering and leaving the band through the same hole, preferably perpendicular to the surface thereof, i.e. perpendicular to the intended edge fold. The thus formed thread loop is kept on the opposite side and formed round a forming member or the like, the seam loop thread obtaining its desired loop shape round the forming member by being tensioned against the forming member, preferably during the forming of the subsequent thread loop.

An advantage of this technique of applying seam loops is that it can be carried out on all types of flat, textile structures that are to be folded along a seam edge, since the technique does not require the existence of any MD thread systems perpendicular to the seam line, or CD thread systems in parallel with the seam line.

Other advantages of the inventive loop-forming technique are:

- the seam can be dimensioned according to the remaining structure in respect of materials and dimensions;
- preformed seam loop spirals need not be kept in stock;
- the endless band need not be prepared or is not damaged in any way;
- the seam loops can be applied with great accuracy;
- the seam loops can be positioned at an exact angle to the edge fold, preferably perpendicular to the major plane of the clothing;
- the method can be carried out at high speed; and
- the resultant seam can satisfy requirements for great uniformity as to pressure, dewatering properties, low marking and the possibility of cleaning.

According to an alternative embodiment of the invention, a technique is suggested that permits the manufacture of seam loops in a clothing having inclined thread systems, especially in a laminated clothing having inclined intersecting thread systems. According to this alternative embodiment of the invention, the seam loops are made from a preformed spiral.

It is true that U.S. Pat. No. 4,896,702 discloses the arranging, in the edge folds of a flattened, doubled band, of preformed seam spirals for forming rows of seam loops along the edge folds. However, the spirals must be inserted in the CD direction and to make this possible, the structure must first be opened along the edge folds by removing special CD filler elements and, optionally, CD threads in the fabric. This known technique therefore cannot be used in a multiaxial laminated clothing having inclined thread systems since there are no MD threads to be ravelled adjacent to the edge folds of a multiaxial laminated construction.

According to the above-mentioned alternative embodiment of the invention, seam loops are manufactured from a preformed spiral, which instead is pulled or pressed through the band transversely of the major plane thereof, preferably substantially perpendicular to the intended edge fold.

Since a preformed spiral is double in the sense that it has one side forming seam loops ("loop side") and one side for anchoring in the band ("mounting side"), it is possible to select which side should be pulled or pressed through the band.

According to a first method of mounting such a spiral, the loop side of the spiral thus is passed through the band from the rear side to the front side of the band. A pintle wire or the like can afterwards be passed through the loops to prevent them from falling back to the rear side.

According to a second method of mounting such a spiral, the mounting side of the spiral is passed through the band from the front side to the rear side of the band. A pintle wire or the like can be passed through the spiral on the rear side of the band to prevent the spiral from falling out on the front side.

For exerting tractive force or compressive force on the spiral for mounting thereof, use can be made of a row of needles or the like, which are passed through the band along the intended edge fold, each needle engaging a spiral loop.

According to the invention, a clothing according to claim 14 is also provided, which comprises, in contrast to the above-described embodiment, two or more endless belts connected in series. The basic principle is the same, but the manufacture of longer clothings is simplified by the technique of connecting in series. The modifications and methods of manufacture as described above for the first embodiment can be used also for the variant connected in series according to claim 14. The endless structure formed of bands connected in series can be openable adjacent to one or more of the coupled-together edge folds, or as an alternative have only permanently coupled-together edge folds.

The invention will now be described in more detail by means of embodiments, with reference to the accompanying drawings, in which FIG. 1 illustrates schematically and from above a per se known method of manufacturing an endless band from a spirally rolled strip;

A method for manufacturing an embodiment of a clothing according to the invention, here a laminated base fabric for a press felt, will now be described with reference to the accompanying drawings. The following description, however, applies generally also to other clothings for a papermaking or cellulose manufacturing machine.

Figure 1:
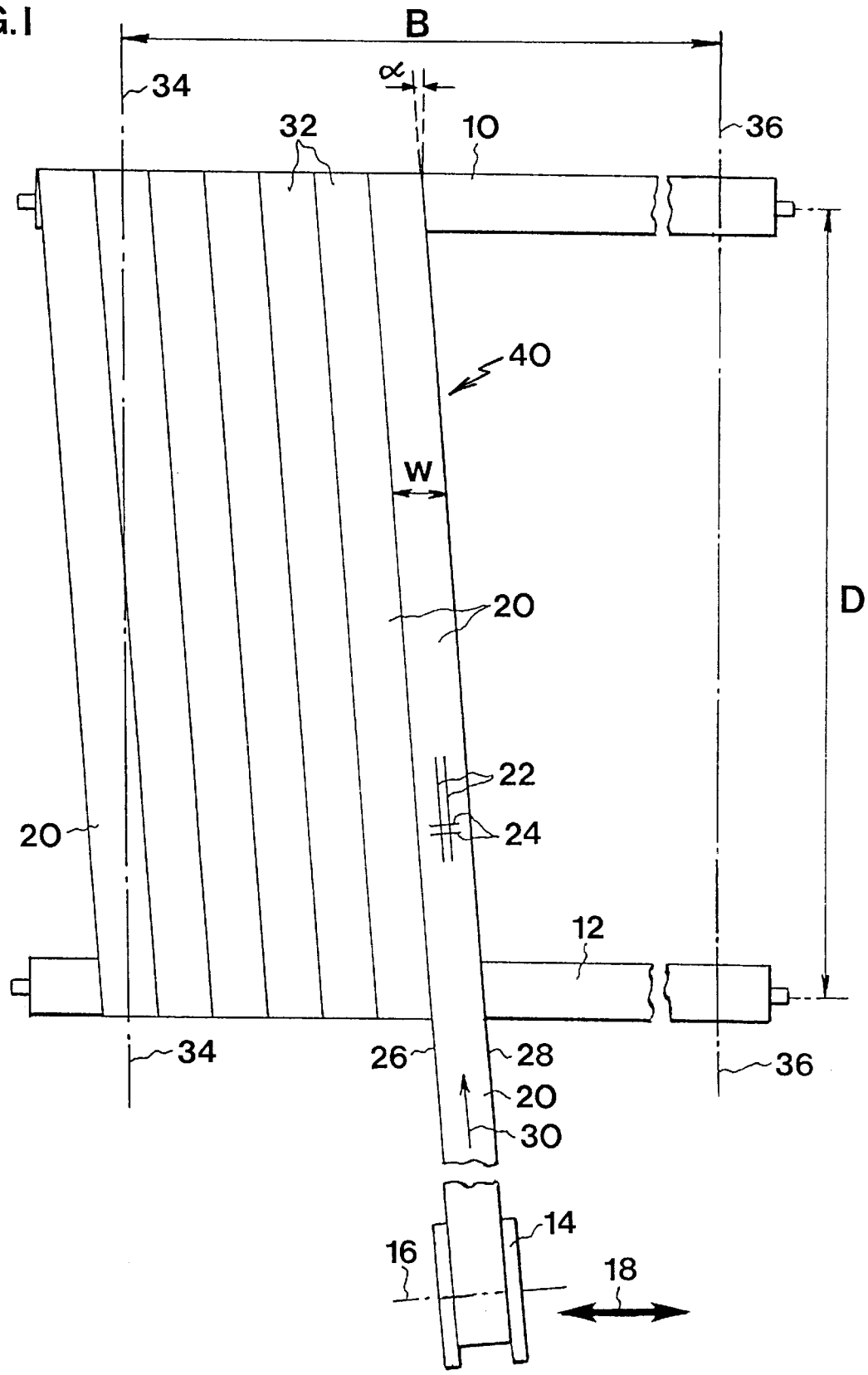
Figure 2:
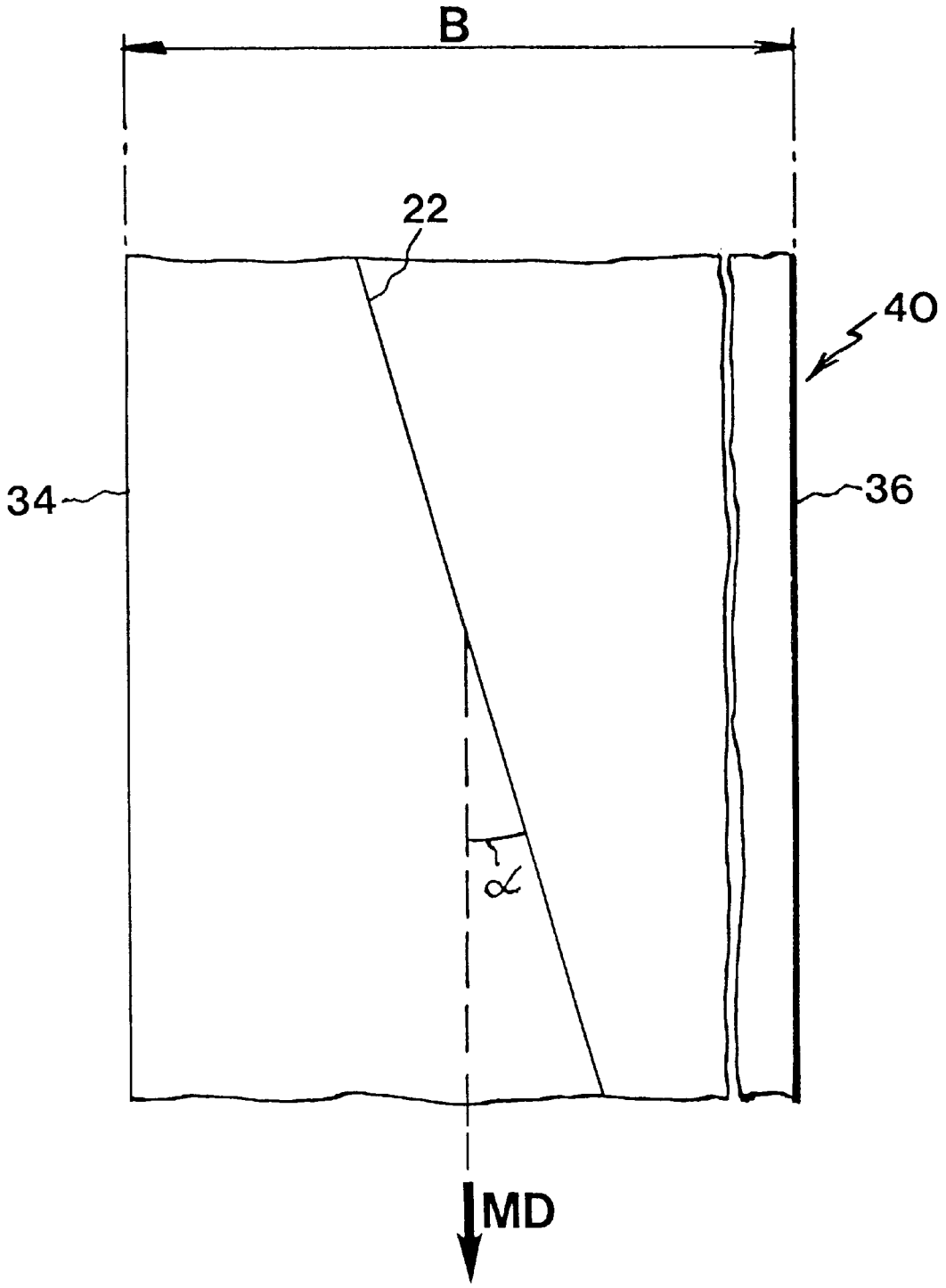
FIG. 2 is a schematic broken-away illustration of the band in FIG. 1 for showing the direction of the threads.

In a first step, an endless band is made from a strip, which is spirally rolled in the same manner as already described above in connection with FIG. 1. Therefore, the description of the spiral rolling technique will not be repeated, since it is known to those skilled in the art from SE 468,602. Thus, the strip 20 is of a width w which is smaller than the width B of the finished base fabric, and in the embodiment illustrated, the strip 20 is flat-woven with longitudinal and transverse thread systems 22, 24, respectively. According to the invention, the axial distance D, however, should be doubled compared with the case in SE 468,602, such that the resultant endless band 40 obtains a circumferential length which is approximately twice the circumferential length of the finished press felt. In other possible embodiments of the invention, the endless band is not composed of a strip, but instead consists of a uniform structure.

Figure 4:
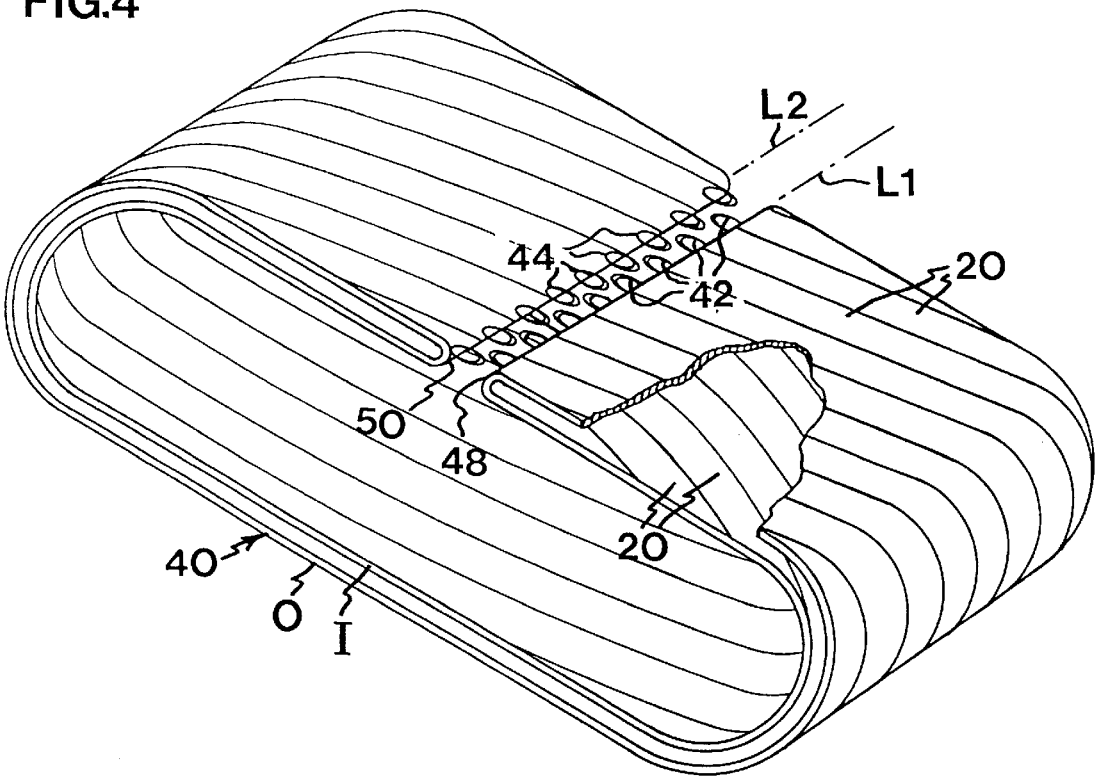
FIG. 4 is a schematic perspective view, conforming to FIG. 3, which shows an embodiment of a clothing according to the invention.
Figure 5:
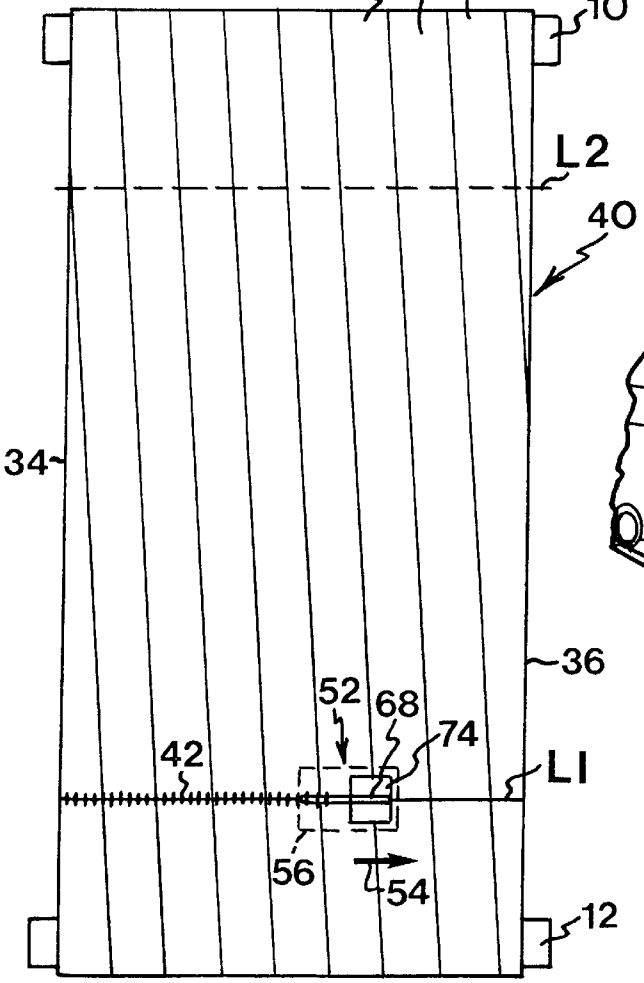
FIG. 5 shows schematically and from above a method for making seam loops on a spirally rolled endless band.

After completion of the spiral rolling, the endless band is provided with two rows of seam loops 42, 44 along seam lines L1 and L2 coinciding with intended edge folds of the band (see FIG. 4). The seam lines L1 and L2 can be marked in advance on the band 40, as indicated in FIG. 5 by a full and a dashed line, respectively. Here it should be especially noted that the seam lines L1 and L2 are inclined relative to the spiral turns of the strip, i.e. inclined in relation to the longitudinal threads 22 as well as the transverse threads 24.

The seam loops 42, 44 are made from a seam loop thread 46 which is separate from the band, preferably monofilament polyamide, in a manner that will be described in more detail below.

After completion of the loops 42, 44, the endless band is flattened such that the seam lines L1 and L2 coincide with two formed edge folds 48, 50. Then the endless band is doubled to the appearance shown in FIG. 4, where the edge folds 48 and 50 with the loop rows 42, 44 are arranged opposite each other. By such flattening and doubling, a laminated structure is obtained, having an outer layer O and an inner layer I.

Figure 3:
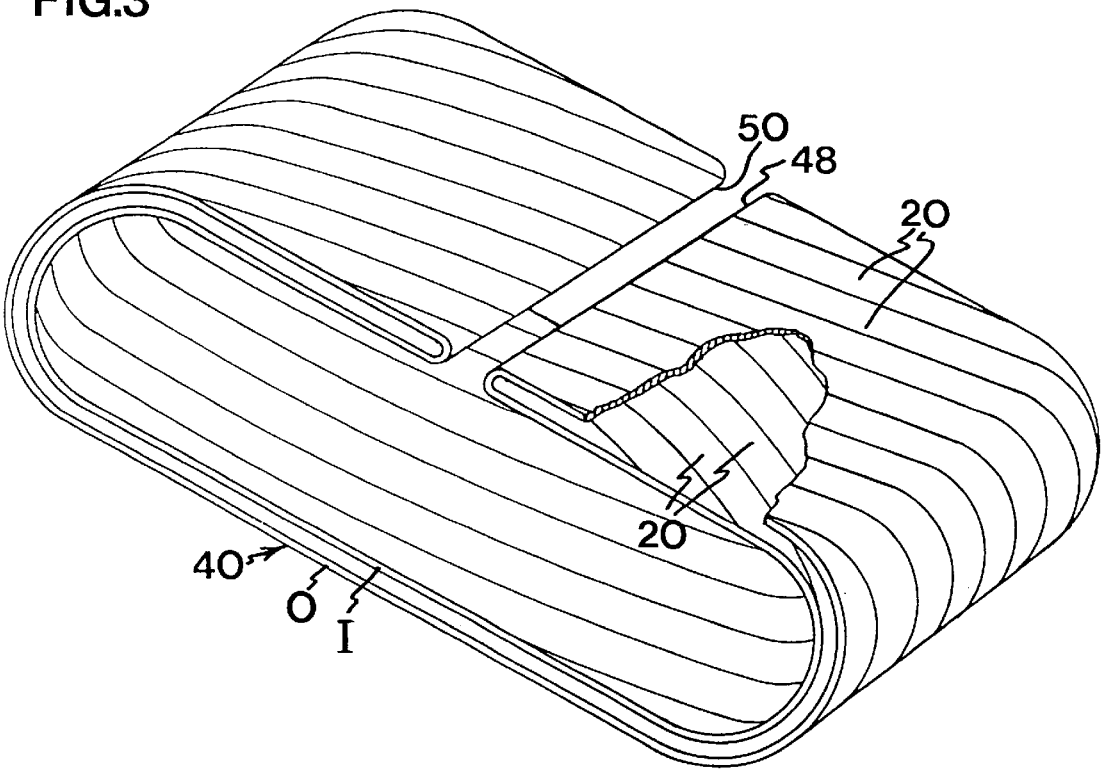
FIG. 3 is a schematic perspective view of the principle for manufacturing a clothing according to the invention.

As is evident from FIGS. 3 and 4, where part of the outer layer O is broken away, it is possible to achieve by this method an automatic crossing of the strips 20 of the inner layer I relative to the strips 20 of the outer layer O. The laminated base fabric 40 therefore has, perpendicularly to its major face, four non-coinciding thread directions which are all inclined relative to the machine direction MD, viz. longitudinal and transverse threads 22, 24 in the inner layer I and longitudinal and transverse threads 22, 24 in the outer layer O.

Figure 6:
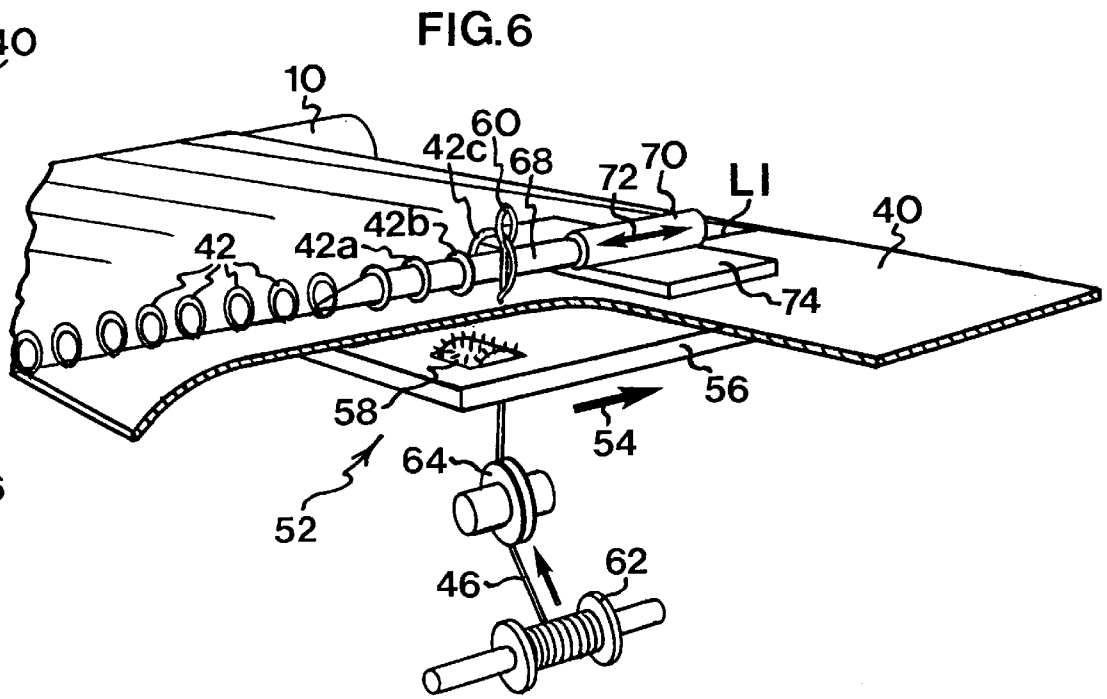
FIG. 6 is a broken-away schematic perspective view of a loop-forming device for carrying out the method in FIG. 5.

To provide the endless band 40 with the seam loops 42, 44 before doubling the band 40 according to FIGS. 3 and 4, use is made in a first embodiment of a loop-forming device 52 shown in FIGS. 5 and 6. The forming of the loops can be carried out directly on the band 40 while this is left on the shafts 10 and 12.

The loop-forming device 52 comprises an upper and a lower part which are caused to move synchronously with each other and intermittently relative to the stationary band 40 above and below, respectively, the seam line L1 in the direction indicated by arrow 54.

The lower part of the loop-forming device 52 comprises a supporting plate 56 abutting against the underside of the band 40, a rotating feeding roller 58 which, under the action of drive means (not shown), causes the intermittent movement, and a thread guide 60 making a reciprocating movement perpendicular to the plate 56 under the action of a drive means (not shown), such as a piston-and-cylinder assembly. Further FIG. 6 schematically illustrates a supply coil 62 storing seam loop thread 46 which, via a roller 64, is fed through an upper eye 66 (see FIG. 7) of the thread guide 60.

The upper part of the loop-forming device 52 comprises an elongate loop-forming member 68 which can be made to perform a reciprocating motion in its longitudinal direction, as marked by a double arrow 72, by means of a piston-and-cylinder assembly 70 mounted on an upper plate 74. The member 68 has, in the embodiment shown, a cross-section conforming with the desired shape of the seam loops 42 and 44 and is extended along a line which is parallel with and slightly offset relative to the seam line L1. Thus, the member 68 is prevented from hitting the thread guide 60, which moves up and down through the band 40 in the actual seam line L1. The plate 74 and the member 68 mounted thereon are made, by drive means (not shown), to move in combination with the lower part of the loop-forming device 52 in the direction of arrow 54.

Figure 7:
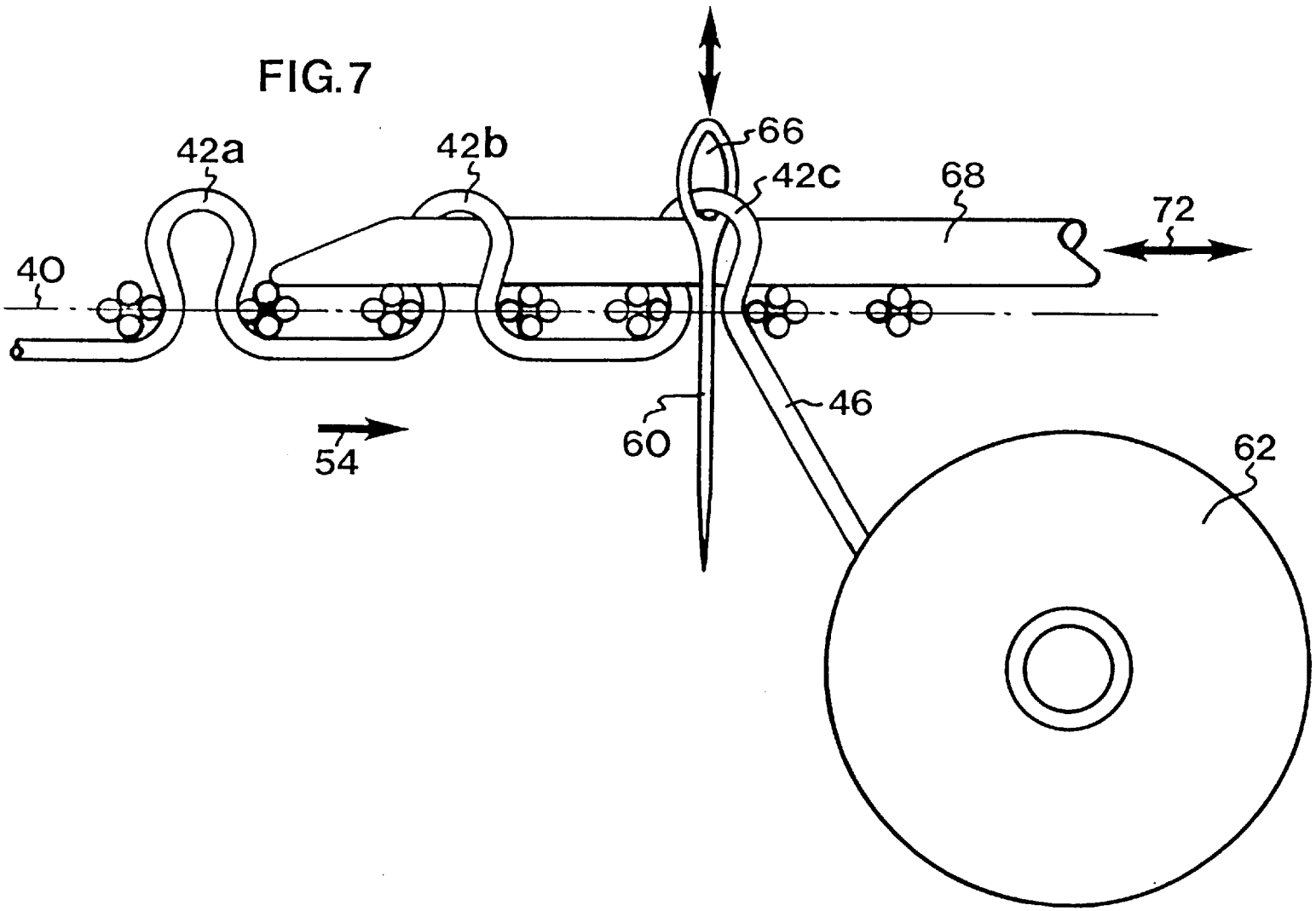
FIG. 7 is a schematic side view for explaining the mode of operation of the loop-forming device in FIG. 6.

The mode of operation of the loop-forming device 52 is more clearly seen from FIG. 7, where the major plane of the endless band is marked with 40, and the band is made of fourfold yarn. Two seam loops 42*a* and 42*b* have already been manufactured to the left of the thread guide 60, and a new seam loop 42*c* is being manufactured. For manufacturing the loop 42*c*, the device 52 performs the following operations.

In a first step, the thread 46 is raised by means of the thread guide 60 upwards through a hole in the band 40. During this first step, the member 68 is inserted in the already formed seam loops 42*a*, 42*b* and the loop-forming device 52 is kept stationary relative to the band 40. In this first step, the new loop 42*c* is not yet positioned on the member 68. Thanks to the member 68 being inserted in the preceding loop 42*b*, the latter is tensioned round the member 68 during this first step.

In a second step, the thread guide 60 still being in its upper position, the member 68 moves to the right out of the already formed loops 42*b*, 42*a* etc. to a retracted position.

In a third step, the thread guide 60 moves downwards, the thread 46 sliding on through the eye 66, such that the new loop 42*c* is formed of the amount of thread that is now positioned on the upper side of the band 40. This new loop 42*c* can in some suitable manner, for instance by guide rails or the like acting on the outsides of the loop, be moved to such a position that in a subsequent step the member 68 can be inserted through the loop 42*c*. An example of such guiding of the loops will be described with reference to the embodiment shown in FIGS. 8–10.

In a fourth step, the member 68 moves to the left, to the situation shown in FIG. 7, for catching on the one hand the new loop 42*c* and, on the other hand, a suitable number of the previously formed loops 42*b*, 42*a*, etc.

In a fifth step, the thread guide 60 moves to its lower turning position under the band 40.

In a sixth step, an indexing in the direction of arrow 54 of the loop-forming device 52 is carried out to the next position along the seam line L1.

The main purpose of the member 68 is to keep back a sufficient amount of thread 46 such that the correct size of the seam loops 42 is formed. If a member 68 of a certain shape is used, it may also, like in this case, be used to form and set the loops 42. The member 68 can be heated for setting. However, it is also possible to set the loops 42 in a separate subsequent process, in which the loops 42 can remain on the member 68, or a new special insert thread (not shown) can be inserted in these to give them the desired shape.

As an alternative to the use of a reciprocating member 68 according to FIGS. 5–7, it is also possible to use two thread systems in the forming of loops, an upper thread replacing the member 68 and being removable later.

The seam loop thread 46 can be a monofilament yarn of a suitable dimension, for instance 0.35–0.50 mm, doubled monofilament yarn, multifilament yarn etc. As illustrative examples, the loops 42, 44 can be formed to a diameter of 1.7 mm and be coupled to an insert thread of 1.5 mm. The thermal treatment can then be carried out, if this has not already been done during the forming operation. The insert thread can then be changed for a thinner thread of for instance 0.7 mm, whereupon the laminated base fabric 40 is provided with a batt layer (not shown) by needling through both layers O and I. In connection with the needling operation, it is possible to insert into the seam loops filler threads (not shown) for forming attachment points for batt fibres. Then the insert thread is removed, whereupon the seam is opened and each row of loops is provided with a protective thread (not shown) for storing and/or transport. Especially if polyamide is selected for the loop thread, it is important to keep the loops under control in respect of shape and size during all process steps up to mounting on the papermaking machine. On the papermaking machine, the felt is mounted in the press section and is closed by means of a coupling thread of, for instance, 1.2 mm consisting of fivefold monofilament yarn of 0.20 mm.

Reference is now made to FIGS. 8–11, which illustrate an alternative embodiment for carrying out the manufacture of loops. The construction and function of the loop-forming device 52 is essentially the same as described above for the embodiment in FIGS. 5–7, and like components are provided with the same reference numerals. The difference between this and the previously described embodiment is above all that the device 52 in FIGS. 8–11 is stationary, and that the endless band 40 is instead made to move relative to the device 52 in the direction of the seam line L1/L2 as indicated by arrow 54 in FIGS. 8–11.

The loop-forming device 52 is mounted on a stationary frame 80, which is arranged approximately in the centre of a horizontal beam 82, which is supported by legs 84 and one end of which is openable at 86, such that the endless band 40 can be slipped over and made to rest on the beam 82. In the shown embodiment, the beam 82 is approximately twice as long as the width B of the band 40.

Figure 9:
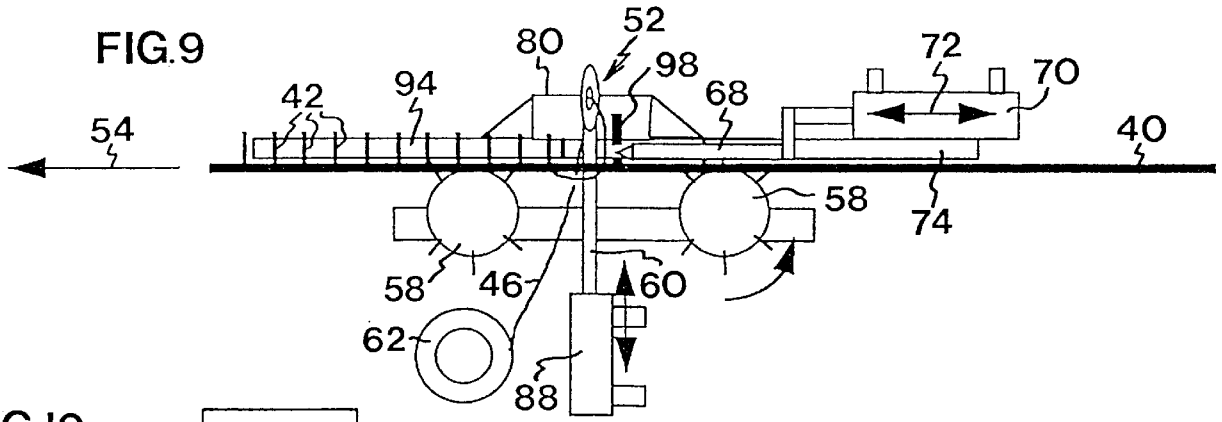
FIG. 9 is a schematic side view showing the loop-forming device in FIG. 8 in more detail.

As is best seen from FIG. 9, the loop-forming device 52 is of essentially the same composition as the device in FIG. 6. FIG. 9 also shows a piston-and-cylinder assembly 88 for driving the thread guide 60 as well as a further feeding roller 58 for the intermittent feeding of the band 40.

Figure 8:
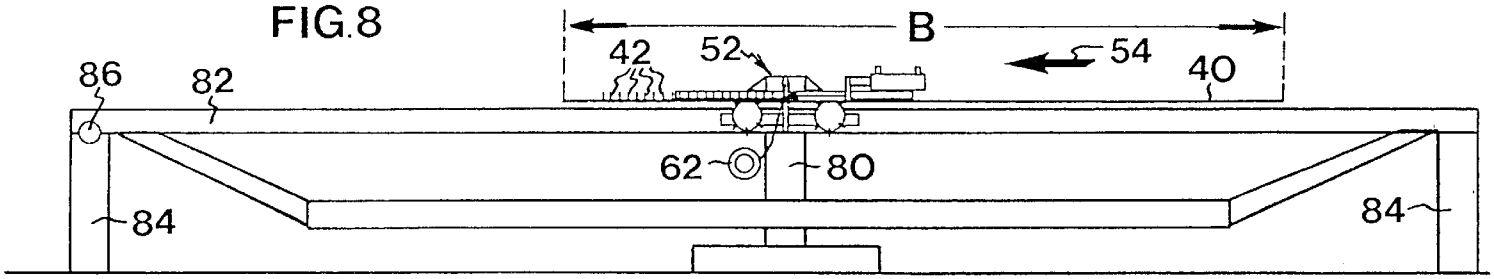
FIG. 8 is a schematic side view of a stationary loop-forming device.

An advantage of the stationary device 52 in FIGS. 8 and 9 is that its upper and lower part are mechanically interconnected, thereby avoiding the requirement that these be guided as two separate parts synchronously with each other as in FIG. 6.

Figure 10:
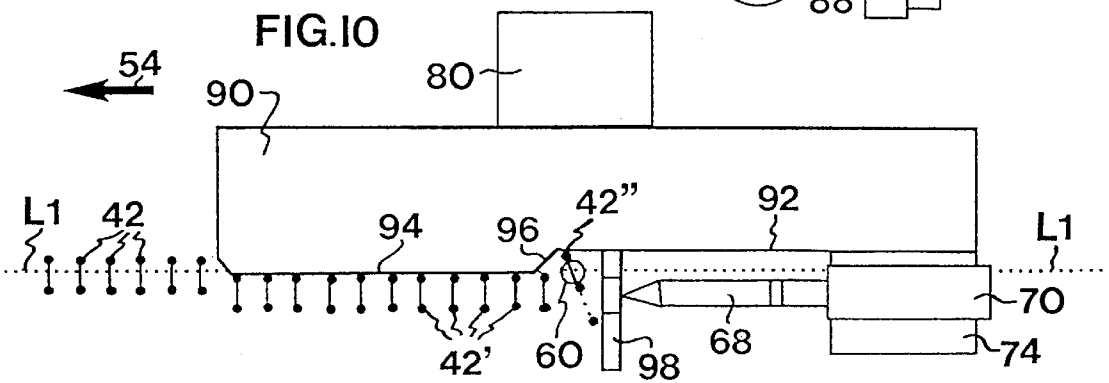
FIG. 10 is a schematic top plan view for explaining the mode or operation of the loop-forming device in FIGS. 8 and 9.
Figure 11:
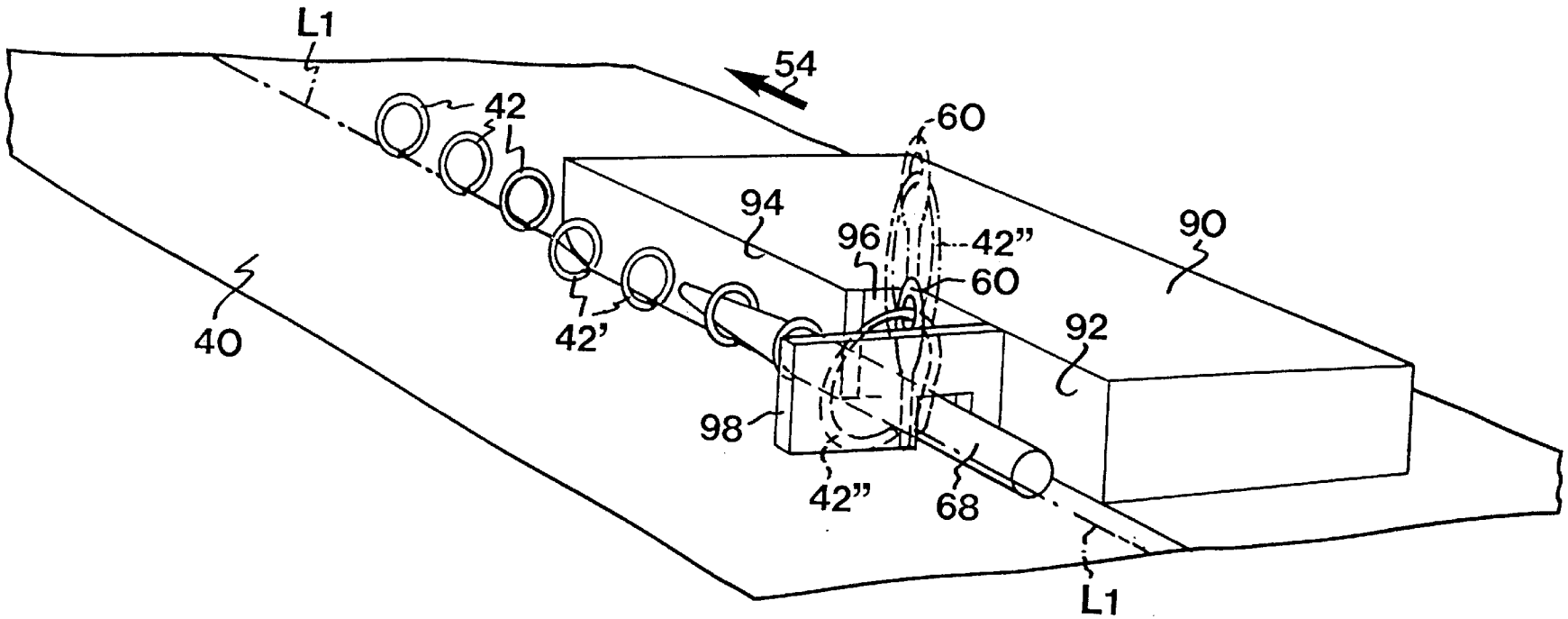
FIG. 11 is a simplified perspective view corresponding to FIG. 10.

FIGS. 10 and 11 illustrate schematically how the loops 42 are guided in the lateral direction during the manufacture of loops, thereby making it possible to catch them and form them round the reciprocating member 68.

A horizontally extended, platform-type guide 90 is fixedly mounted on the frame 80 and comprises along its long side facing the member 68 and the loops 42 a first guiding wall 92 and a second guiding wall 94, which are interconnected as shown in FIG. 10 and which are interconnected via an inclined partition 96. The loop 42" which is presently being formed by the thread guide 60 is positioned adjacent to the first guiding wall 92 immediately adjacent to the inclined partition 96. When the loop 42" has been formed and the band 40 is being indexed in the direction of arrow 54, the loop will, under the action of the inclined partition 96, be guided aside, away from the seam line L1 to a laterally offset position which coincides with the path of movement of the member 68. An optional number of loops, designated 42' in FIG. 10, are held in this laterally offset position by the second guiding wall 94.

When the loops 42 leave the loop-forming device 52, they return to a position coinciding with the seam line L1, as indicated to the left in FIG. 10.

FIG. 10 also shows an abutment 98 which prevents the newly formed loop 42" from turning forwards to such an extent that the member 68 misses the loop.

Figure 12:
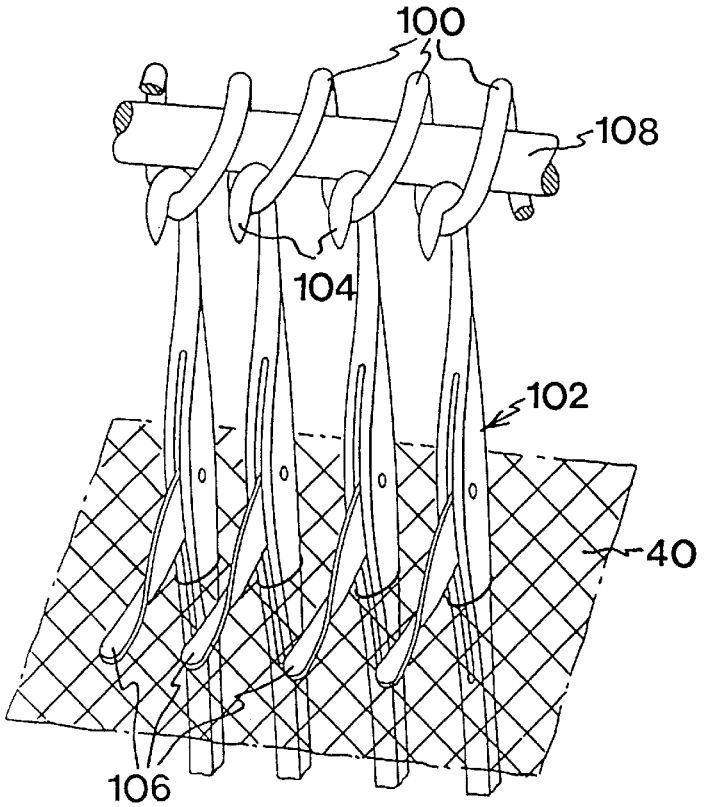
FIGS. 12–14 are broken-away schematic perspective views which illustrate different steps of a method for mounting a preformed spiral.
Figure 13:
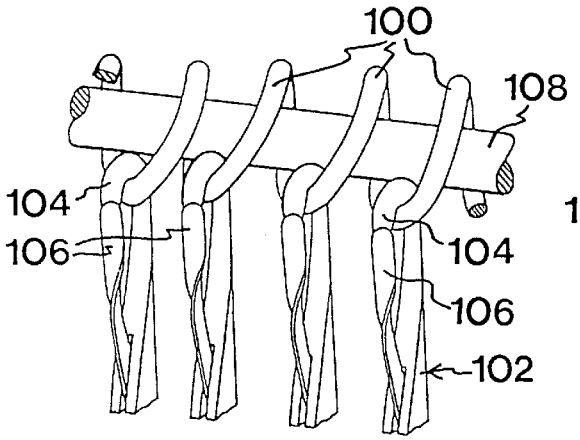
Figure 14:
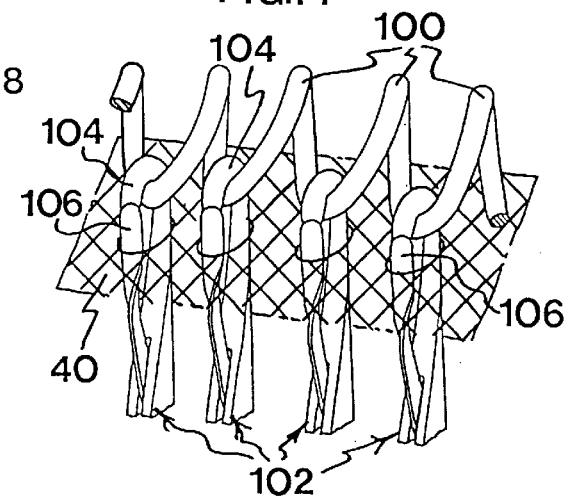

Reference is now made to FIGS. 12–14 which illustrate a different method for manufacturing the seam loops 42, 44. According to this method, use is made, adjacent to each edge fold 48, 50, of a spiral 100 known to those skilled in the art and made of, for instance, polyamide. The band 40 may, for instance, but not necessarily, be a woven structure, the stitches being used for the mounting of the spiral 100.

For mounting a spiral 100, use is made of a set of needles 102, each essentially having the form of a crochet needle with a "hook" 104 at one end. Each needle 102 also comprises a pivotable locking arm 106, whose function will be described below.

The needles 102 are first pressed through the band 40, for instance, from the rear side of the band 40 towards its front side. The articulated locking arms 106 are parallel with the needle 102 and directed downwards to be able to pass through the band 40. The needles 102 are pressed through so far that the free ends of the locking arms 106 can be made to rest against the band on the exit side of the needles, as shown in FIG. 12.

The hooks 104 of the needles 102 are then attached in the spiral loops, on the loop side or mounting side of the spiral 100, as mentioned above, whereupon a pintle rod or wire 108 is passed through the spiral 100 to prevent the spiral 100 from releasing the hooks 104.

Subsequently, the needles 102 are moved in the opposite direction, each locking arm 106 being moved, under the action of the band 40, to a locked position, according to FIG. 13, where the locking arm together with the associated hook 104 forms a closed eye of the needle, in which the spiral loop is caught.

The pintle rod or wire 108 can now be removed (alternatively replaced by a thinner one), whereupon the needles 100 can be pulled back the last distance down through the band 40, as illustrated in FIG. 14.

The spiral 100 is mounted in the correct position in the band 40 and can be fixed in some suitable manner, for instance by inserting a pintle wire in the CD direction through the spiral on the rear side of the band 40.

The seem loops or alternatively the spirals could be mounted on the band before making this endless, if the band is manufactured in some other manner than described above.

When the rows of loops are coupled to an insert wire, it is also possible to insert, as is per se already known, one or more filler threads for controlling the permeability in the seam area and, if required, provide a better batt attachment.

Finally, mention should also be made of the possibility of arranging two or more parallel rows of loops adjacent to the edge folds if the clothing is relatively thick. With double rows of loops, it will be possible to prevent variations in thickness in the coupled-together edge folds.

What is claimed is:

1. A laminated clothing for a papermaking or cellulose manufacturing machine, said clothing having in its thickness direction a first layer and, laminated therewith, a second layer, each of said first and second layers having an inclined direction-defined thread system, said thread systems of said first and second layers being inclined relative to the machine direction (MD) of said clothing and relative to one another, wherein said first layer and said second layer are fashioned from an endless band, said endless band being flattened to produce said first layer and said second layer and two edge folds extending transversely of the machine direction (MD), said flattened endless band being doubled and said two edge folds coupled to each other, whereby said first layer and said second layer are an outer part and an inner part of said laminated clothing, said endless band having a direction-defined thread system, said direction-defined thread system being inclined relative to the machine direction (MD) and, owing to said flattening and doubling of said band, forming said direction-defined thread systems, inclined relative to each other, of said first layer and said second layer, said two edge folds being coupled to each other by two rows of seam loops, one of said rows being on each of said edge folds, said seam loops being adapted to form, together with a pintle wire, an openable seam of the clothing, each row of seam loops being formed separately from said band material from a thread separate from the band material.

2. The clothing as claimed in claim 1, wherein said endless band is formed of a spirally rolled strip, which has a width (w) smaller than the width (B) of said band and which has a direction-defined thread system extended in the longitudinal direction of said strip and forming said inclined, direction-defined thread system of said band.

3. The clothing as claimed in claim 1, wherein said endless band is made of a fabric made from yarn.

4. The clothing as claimed in claim 3, wherein said endless band is woven.

5. A method for manufacturing a laminated clothing for a papermaking or cellulose manufacturing machine, said clothing having in its thickness direction a first and, laminated therewith, a second layer, each having an inclined direction-defined thread system, said thread systems being inclined relative to the machine direction (MD) of the clothing and relative to each other, said method comprising the following steps:

a) making an endless band, which is of a circumference which is approximately twice the length of the circumference of the finished clothing and which has an inclined direction-defined thread system making an angle with the longitudinal direction (MD) of said band, b) flattening said band, thereby forming two edge folds, and c) doubling said flattened band by joining and coupling together said two edge folds, such that the outer half and inner half of the doubled band form the first layer and the second layer, respectively, and such that said direction-defined thread systems of the first and the second layer both form part of said inclined, direction-defined thread system of said band, wherein said step of coupling together said edge folds comprises providing two rows of seam loops, each row of seam loops being formed separately from said endless band by a separate thread which is successively introduced into said band along an intended seam line (L1,L2), one row being along each of said edge folds, to form an openable loop seam together with a pintle wire.

6. The clothing as claimed in claim 5, wherein the step of making said endless band comprises the following partial steps:

a1) making a strip which is of a width (w) smaller than the width of the clothing and which has a direction-defined thread system extended in its longitudinal direction, and a2) spirally rolling said strip to form said endless band, the inclined, direction-defined thread system (22) of the band consisting of said thread system of said strip.

7. The method as claimed in claim 6, wherein the partial step of making said strip comprises the measure of flat-weaving the same.

8. A laminated clothing for a papermaking or cellulose manufacturing machine, said clothing having in its thickness direction a first layer and, laminated therewith, a second layer, each of said first and second layers having an inclined direction-defined thread system, said thread systems of said first and second layers being inclined relative to the machine direction (MD) of said clothing and relative to one another, wherein said first layer and said second layer are fashioned from an endless band, said endless band being flattened to produce said first layer and said second layer and two edge folds extending transversely of the machine direction (MD), said flattened endless band being doubled and said two edge folds coupled to each other, whereby said first layer and said second layer are an outer part and an inner part of said laminated clothing, said endless band having a direction-defined thread system, said direction-defined thread system being inclined relative to the machine direction (MD) and, owing to said flattening and doubling of said band, forming said direction-defined thread systems, inclined relative to each other, of said first layer and said second layer, said two edge folds being coupled to each other by two rows of seam loops, one of said rows being on each of said edge folds, said seam loops being adapted to form, together with a pintle wire, an openable seam of the clothing, each row of seam loops being formed separately from said band material from a preformed spiral separate from the band material.

9. The clothing as claimed in claim 8, wherein said endless band is formed of a spirally rolled strip, which has a width (w) smaller than the width (B) of said band and which has a direction-defined thread system extended in the longitudinal direction of said strip and forming said inclined, direction-defined thread system of said band.

10. The clothing as claimed in claim 8, wherein said endless band is made of a fabric made from yarn.

11. The clothing as claimed in claim 10, wherein said endless band is woven.

12. A method for manufacturing a laminated clothing for a papermaking or cellulose manufacturing machine, said clothing having in its thickness direction a first and, laminated therewith, a second layer, each having an inclined direction-defined thread system, said thread systems being inclined relative to the machine direction (MD) of the clothing and relative to each other, said method comprising the following steps:

a) making an endless band, which is of a circumference which is approximately twice the length of the circumference of the finished clothing and which has an inclined direction-defined thread system making an angle with the longitudinal direction (MD) of said band, b) flattening said band, thereby forming two edge folds, and c) doubling said flattened band by joining and coupling together said two edge folds, such that the outer half and inner half of the doubled band form the first layer and the second layer, respectively, and such that said direction-defined thread systems of the first and the second layer both form part of said inclined, direction-defined thread system of said band, wherein said step of coupling together said edge folds comprises providing two rows of seam loops, each row of seam loops being formed separately from said endless band from a separate, preformed spiral, whose one side is passed through said band transversely of the major plane thereof, one row being along each of said edge folds, to form an openable loop seam together with a pintle wire.

13. The method as claimed in claim 12, wherein the step of making said endless band comprises the following partial steps:

a1) making a strip which is of a width (w) smaller than the width of the clothing and which has a direction-defined thread system extended in its longitudinal direction, and a2) spirally rolling said strip to form said endless band, the inclined, direction-defined thread system of said band consisting of said thread system of said strip.

14. The method as claimed in claim 13, wherein the partial step of making said strip comprises the measure of flat-weaving the same.

* * * * *